United States Patent [19]

Caris

[11] 4,334,668

[45] Jun. 15, 1982

[54] PORTABLE FOLDABLE HOIST

[76] Inventor: Daniel D. Caris, 3540 Court St., Redding, Calif. 96003

[21] Appl. No.: 235,009

[22] Filed: Feb. 17, 1980

[51] Int. Cl.[3] ..... B66F 5/02

[52] U.S. Cl. ..... 254/8 B

[58] Field of Search ..... 254/8 R, 8 B, 2 R, 2 B, 254/124; 5/86

[56] References Cited

U.S. PATENT DOCUMENTS

| | | | |
|---|---|---|---|
| 3,931,956 | 1/1976 | Hawkins | 254/8 B |
| 4,021,017 | 5/1977 | Adams | 254/8 B |
| 4,118,010 | 10/1978 | Hanscom | 254/124 |
| 4,190,233 | 2/1980 | Godfrey | 254/8 B |

FOREIGN PATENT DOCUMENTS

| | | | |
|---|---|---|---|
| 218600 | 11/1958 | Australia | 5/86 |
| 2003769 | 11/1970 | Fed. Rep. of Germany | 254/8 R |

*Primary Examiner*—Robert C. Watson

*Attorney, Agent, or Firm*—Leonard Dale Schappert

[57] ABSTRACT

A portable hoist is provided and is adapted to be used for lifting and moving heavy objects or loads such as automobile engines, etc. The hoist is designed such that it is portable, in that it is fully foldable into a small, compact unit for storage or transport. The hoist is further mounted on rollable wheels, thereby permitting movement when loaded.

4 Claims, 5 Drawing Figures

PORTABLE FOLDABLE HOIST

BACKGROUND OF THE INVENTION

This invention relates generally to lifting and mounting devices known as hoists, and more particularly to portable foldable hoists designed for ease of operation, maneuverability and storage within a small area.

Heretofore, relevant art taught hoists which were strong and utilitarian, but quite cumbersome. While some such devices could be taken apart and stored, breaking them down for storage was a major operation, as was reassembling them. When assembled, these devices were large, cumbersome and unwieldy in operation, and required large storage space. When dissembled for easier storage, because of the large number of parts, some parts were easily lost. None of the prior art shows the unique structure which is disclosed by applicant.

Prior art patents which may be relevant to this device are U.S. Pat. Nos. 3,931,956; 4,021,017; 4,190,233; and 4,118,010.

SUMMARY OF THE INVENTION

This invention is a hoist or lifting device for lifting and transporting heavy objects, such as automobile engines, etc., on a surface. The hoist consists of an essentially vertical standard attached to a base with a pin, and with a boom attached to the top of the vertical standard, such boom being raised or lowered through the use of a hydraulic cylinder or the like mounted with one end attached to said boom and the other end attached to the standard. Attached to and made part of the base are two legs which will swing inward or outward for purposes of storage or usage. In either position, inward or outward, the legs are lockable so as to increase stability. The base and the two legs just mentioned are supported on three rollable wheels, thereby permitting movement of the hoist. The hoist is designed such that all of the parts fold together into a compact, essentially rectangular unit upon the removal of one pin.

One object of the present invention is to provide an easily maneuverable, strong and safe hoist.

Another object of the present invention is to provide a hoist which is easily foldable, so as to form a compact and easily storable unit.

Another object of the present invention is to provide a lightweight hoist, which, when folded up, is easily movable and transportable.

Another objective of the present invention is to provide a hoist which is readily usable and storable by individuals not associated with professional garages.

DESCRIPTION OF THE PREFERRED EMBODIMENT

Figure 1:
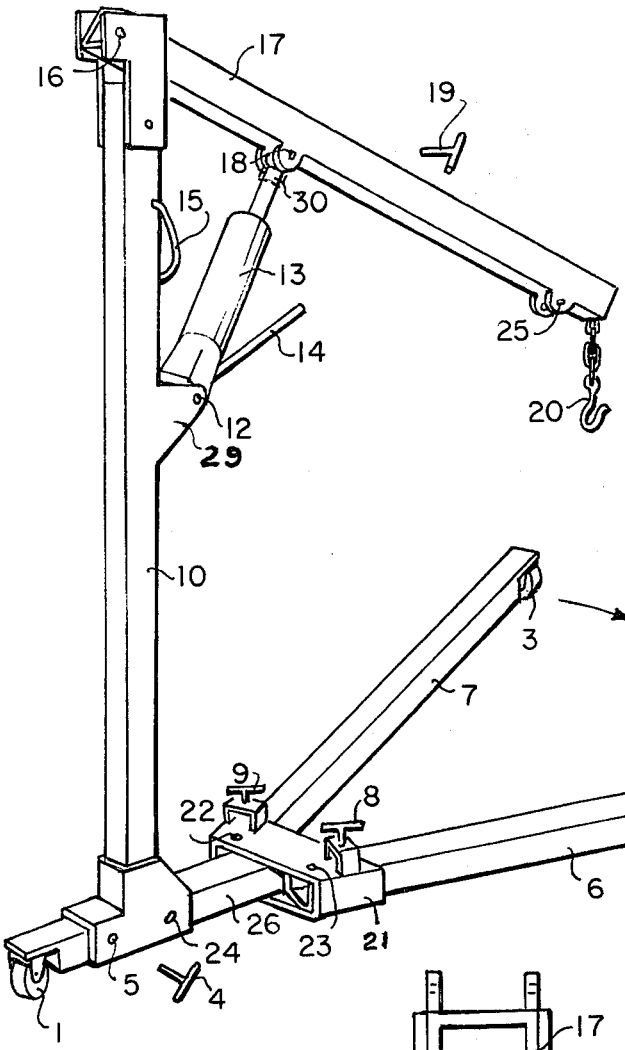
FIG. 1 is a perspective view, illustrating a hoist constructed in accordance with my invention, and indicating the movement of the legs involved in folding the hoist.

Referring in more detail to FIG. 1 of the drawings, there is illustrated an apparatus for lifting and transporting heavy objects. The apparatus includes a base, designated generally as (21) and (26). Base portion (26) is constructed of square tubular metal and is welded to base portion (21), which is made of heavy metal sheet. The vertical member (10), which is constructed of square tubular metal, is connected to the base (26) by a permanent pin (24), upon which the vertical member (10) may pivot when not in a locked position. The vertical member (10) is locked in an upright position through the use of pin (4) in hole (5). The legs (6) and (7), which are constructed of square tubular metal, are connected to the base (21) through the use of permanent pins (22) and (23). The legs (6) and (7) are shown in the operable position and locked. The arrows indicate the movement of the legs required to fold the hoist for storage. The locking mechanisms (8) and (9) lock the legs in place in either the operating condition or the folded condition. Wheels (2) and (3) are provided on the legs, and the hoist is movable generally on wheels (1), (2) and (3).

At the upper end of the vertical member (10) a boom (17), which is constructed of square tubular metal, is connected through the use of a pin (16). A hydraulic jack (13) is provided to raise and lower the boom (17) of the hoist. The hydraulic jack (13) is connected to the brace (29), which is constructed of heavy metal sheet, through the use of a permanent pin (12). Brace (29) is attached to vertical member (10) by welding. The hydraulic jack (13) is positioned on the boom (17) by securing with pin (19) through hole (18), or by fitting into socket (30). The metal holder (15), which is constructed of heavy wire, is attached to the vertical member (10), and is used for securing the hydraulic jack (13) when the hoist is folded up. A chain and hook (20) are connected to the end of the boom (17), and are provided for purposes of attachment to the device to be lifted. An alternative arrangement (25) is provided, wherein a chain can be attached through the use of a pin.

Figure 2:
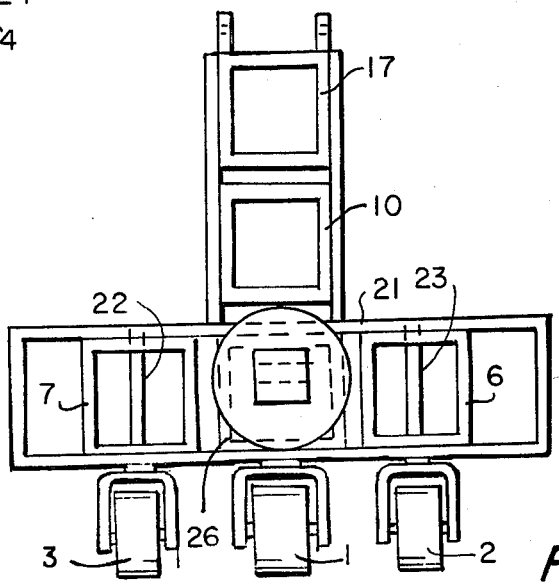
FIG. 2 is an end view showing the hoist of FIG. 1.

Now proceeding to FIG. 2, it can be seen that the vertical member (10), the boom (17), the legs (6) and (7) and the base (26) are made of tubular metal. While, as shown in this preferred embodiment, the tubular metal is square, with minor modifications, cylindrical tubular metal would work equally well. The locking mechanisms (8) and (9) shown in FIG. 1 are not shown in FIG. 2 for purposes of clarity. It can further be seen that base (21) is made of thick metal sheet, welded at the corners.

Figure 3:
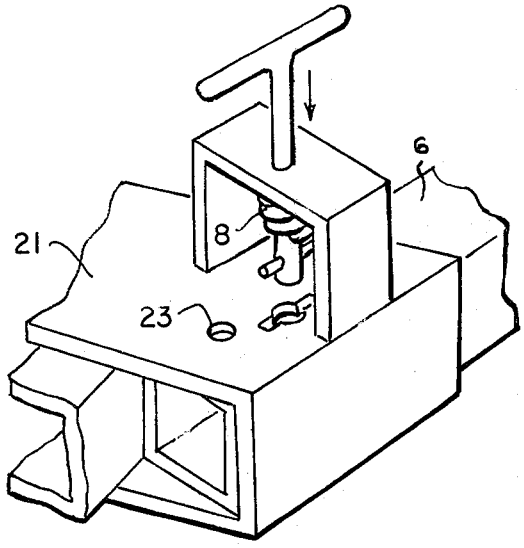
FIG. 3 is an expanded view showing the pivot and locking areas relating to the legs of the invention of FIG. 1.

Now referring to FIG. 3, the base (21) is shown in more detail. The leg (6) pivot on pin (23). The locking mechanism (8) is a sprung pin as shown. This locking mechanism is the subject of an additional and separate application not yet filed. When said pin is pulled upward, this permits the leg (6) to pivot and, when released, locks the leg in either the open or the folded position.

Figure 5:
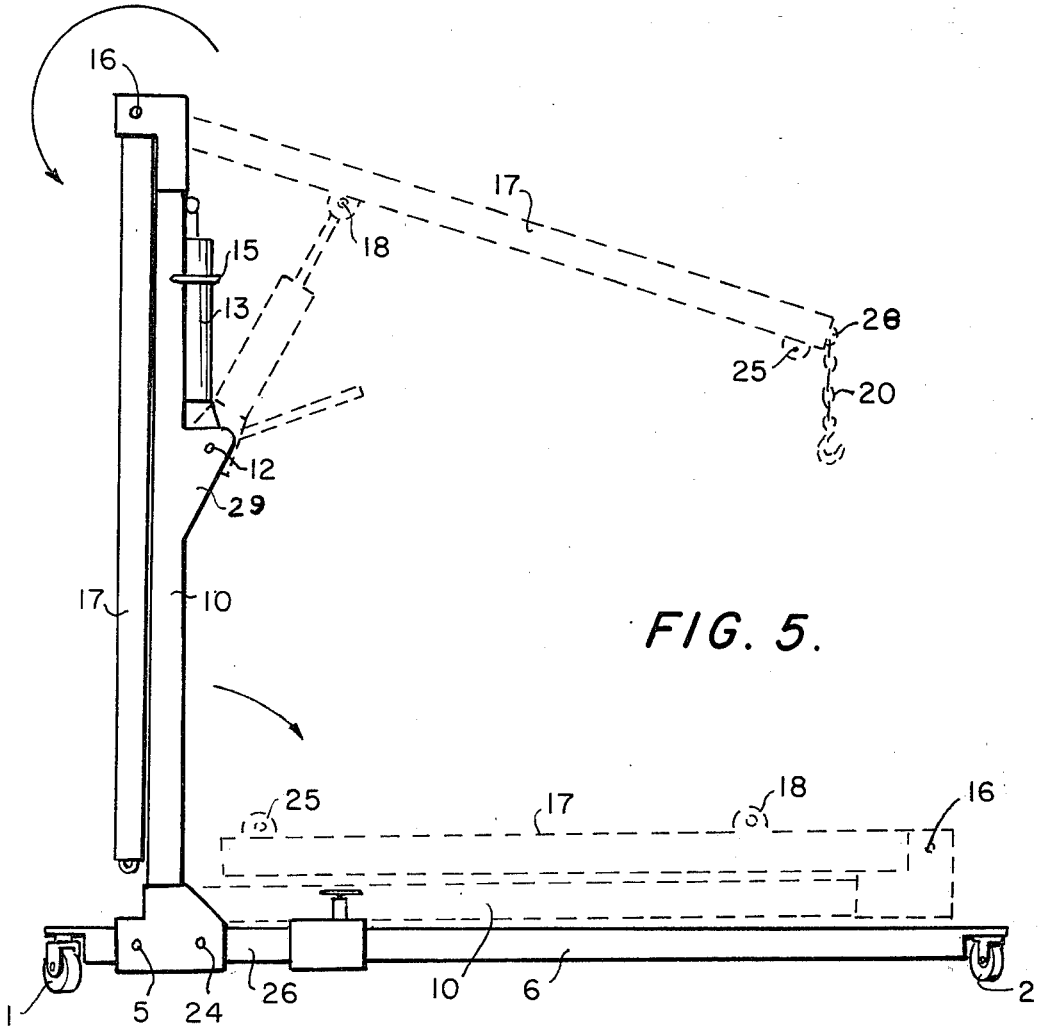
FIG. 5 is a side view of the hoist of FIG. 1, indicating the movement of the several parts involved in folding up the hoist.

Now going to FIG. 5, it can be seen that, when pin (18) is removed, the boom (17), pivoting on pin (16), swings over the top and down along the side of vertical member (10). At the same time, the hydraulic cylinder (13), pivoting on pin (12), swings into vertical member (10) and is held in place by the retaining wire (15).

When pin (5) is removed, the vertical member (10), pivoting on pin (24), swings down to a horizontal position, essentially as shown by the dotted lines in FIG. 5.

Figure 4:
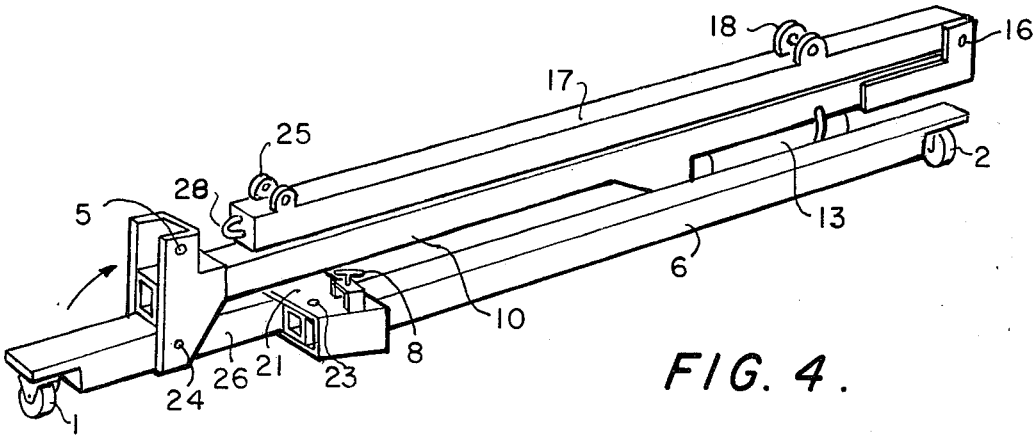
FIG. 4 is a perspective view of the hoist of FIG. 1 showing it in a fully folded position.

FIG. 4 shows the hoist in a fully folded condition and easily storable.

While the foregoing description of the invention has shown a preferred embodiment using specific terms, such description is for illustrative purposes only. It is the applicant's intention that changes and variations may be made without departing from the spirit or scope of the following claims, and this disclosure is not intended to limit the applicant's protection in any way.

I claim:

1. A foldable apparatus for lifting and moving heavy objects, comprising:

a base having a front end and a rear end;

a plurality of legs attached to and extending horizontally from said base;

a vertical member pivotally connected at its lower end to said base whereby it folds down against said base, and having:

a substantially horizontal extension rigidly attached to the upper end of said vertical member and extending substantially parallel to and in the direction of the rear end of said base; and means for locking said vertical member with respect to said base;

a lifting beam pivotally connected at one end to said substantially horizontal extension such that the pivot point is offset from said vertical member toward the rear end of said base, while said lifting beam extends over the top of said vertical member in the direction of the front end of said base, whereby the downward movement of said lifting beam is limited when it comes to rest on said vertical member, and whereby said lifting beam swings over the upper end of said vertical member and folds down against the side of said vertical member closest to the rear end of said base; and a jack unit pivotally connected at one end to said vertical member and having quick disconnect means pivotally connecting the other end to said lifting beam, whereby said jack unit easily attaches to and disconnects from said lifting beam.

2. A foldable apparatus for lifting and moving heavy objects, comprising:

a base having a front end and a rear end;

a plurality of legs attached to and extending horizontally from said base;

a vertical member pivotally connected at its lower end to said base whereby it folds down against said base, and having:

a substantially horizontal extension rigidly attached to the upper end of said vertical member and extending substantially parallel to and in the direction of the rear end of said base; and means for locking said vertical member with respect to said base;

a lifting beam pivotally connected at one end to said substantially horizontal extension such that the pivot point is offset from said vertical member toward the rear end of said base, while said lifting beam extends over the top of said vertical member in the direction of the front end of said base, whereby the downward movement of said lifting beam is limited when it comes to rest on said vertical member, and whereby said lifting beam swings over the upper end of said vertical member and folds down against the side of said vertical member closest to the rear end of said base; and a jack unit pivotally connected at one end to said base and having quick disconnect means pivotally connecting the other end to said lifting beam, whereby said jack unit easily attaches to and disconnects from said lifting beam.

3. The apparatus set forth in claim 1 or 2, wherein said legs are pivotally connected to said base, whereby said legs swing with respect to said base and with respect to each other.

4. The apparatus of claim 3, wherein locking means are provided to lock the position of said legs with respect to said base.

* * * * *